US009341180B2

(12) United States Patent
Spielvogel

(10) Patent No.: US 9,341,180 B2
(45) Date of Patent: May 17, 2016

(54) CONNECTION PLATE FOR A HYDROSTATIC PISTON MACHINE

(75) Inventor: Christian Spielvogel, Eutingen (DE)

(73) Assignee: Robert Bosch GmbH, Stuttgart (DE)

( * ) Notice: Subject to any disclaimer, the term of this patent is extended or adjusted under 35 U.S.C. 154(b) by 658 days.

(21) Appl. No.: 13/641,558

(22) PCT Filed: Mar. 12, 2011

(86) PCT No.: PCT/DE2011/000255

§ 371 (c)(1),
(2), (4) Date: Jan. 2, 2013

(87) PCT Pub. No.: WO2011/127883

PCT Pub. Date: Oct. 20, 2011

(65) Prior Publication Data

US 2013/0195699 A1 Aug. 1, 2013

(30) Foreign Application Priority Data

Apr. 16, 2010 (DE) ..... 10 2010 015 187

(51) Int. Cl.
*F04B 53/10* (2006.01)
*F03C 1/06* (2006.01)
(Continued)

(52) U.S. Cl.
CPC ..... *F04B 53/10* (2013.01); *F03C 1/0628* (2013.01); *F03C 1/0663* (2013.01); *F04B 1/145* (2013.01);
(Continued)

(58) Field of Classification Search
CPC ..... F03C 1/0628; F03C 1/0663; F04B 1/145; F04B 1/2064; F04B 1/324; F04B 53/10; F04B 53/16; F04B 53/007; F04B 39/125; F04B 39/121; F04B 49/08
USPC ..... 417/437
See application file for complete search history.

(56) References Cited

U.S. PATENT DOCUMENTS 2,299,234 A * 10/1942 Snader et al. ..... 417/222.1
4,690,036 A 9/1987 Kosaka et al.
(Continued)

FOREIGN PATENT DOCUMENTS

| | | | |
|---|---|---|---|
| DE | 199 04 616 | A1 | 8/2000 |
| DE | 101 36 416 | A1 | 2/2003 |
| DE | 44 10 156 | B4 | 3/2007 |
| DE | 10 2007 044 451 | A1 | 3/2009 |
| GB | 1 433 024 | A | 4/1976 |
| WO | 2009/037069 | A1 | 3/2009 |

OTHER PUBLICATIONS

International Search Report corresponding to PCT Application No. PCT/DE2011/000255, mailed Jul. 15, 2011 (German and English language document) (7 pages).

*Primary Examiner* — Justin Jonaitis
*Assistant Examiner* — Stephen Mick
(74) *Attorney, Agent, or Firm* — Maginot, Moore & Beck LLP

(57) ABSTRACT

A connection plate for a hydrostatic piston machine includes two connection openings on opposite lateral surfaces of the connection plate. The connection openings are arranged at an offset from a main axis of the connection plate on a common side. Two slotted recesses are formed from an inner face of the connection plate. The slotted recesses are each connected in the area of the first end section of the slotted recesses to one of the connection openings in order to connect the piston machine to a hydraulic circuit. A valve cartridge is inserted in an installation bore of the connection plate. The installation bore is formed opposite the plate axis in the connection plate with respect to the connection openings and extends approximately parallel to axes of the connection openings. The valve cartridge is hydraulically connected to one of the slots.

14 Claims, 7 Drawing Sheets

Figure 1:
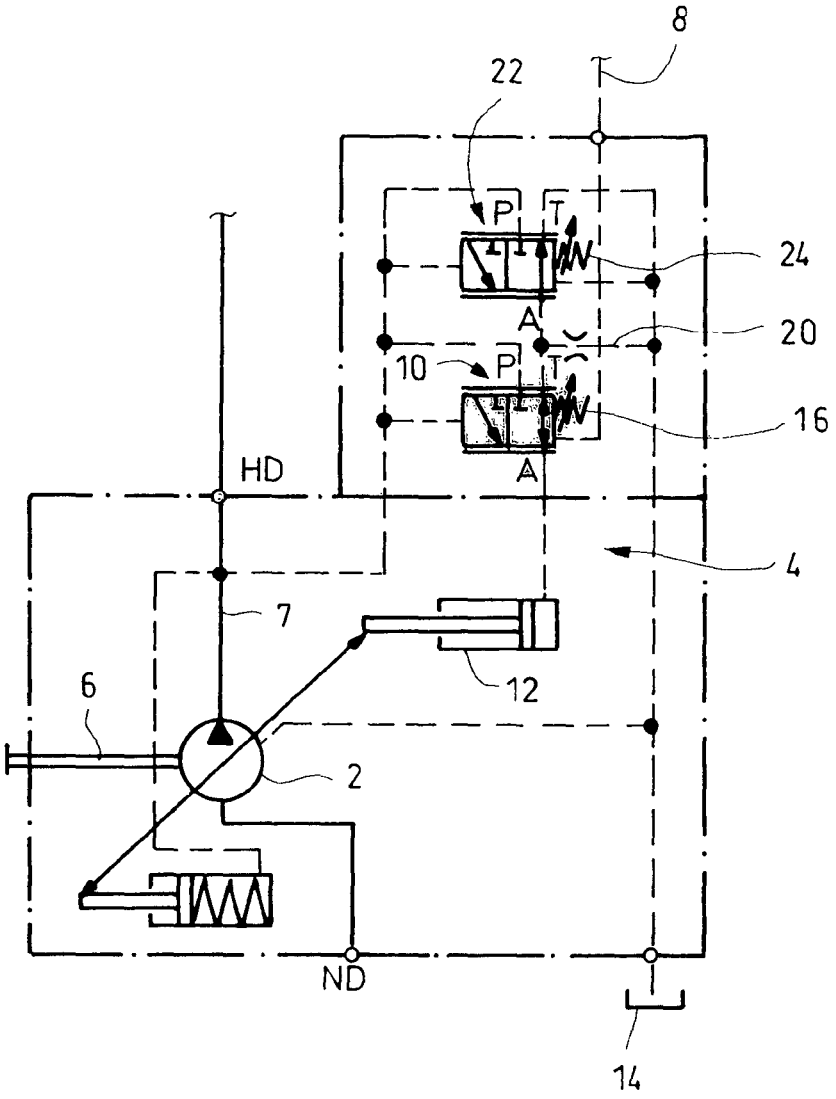

(51) Int. Cl.

| | |
|---|---|
| ***F04B 1/14*** | (2006.01) |
| ***F04B 1/20*** | (2006.01) |
| ***F04B 1/32*** | (2006.01) |
| ***F04B 39/12*** | (2006.01) |
| ***F04B 49/08*** | (2006.01) |
| ***F04B 53/00*** | (2006.01) |
| ***F04B 53/16*** | (2006.01) |

(52) U.S. Cl.

CPC ..... *F04B 1/2064* (2013.01); *F04B 1/324* (2013.01); *F04B 39/121* (2013.01); *F04B 39/125* (2013.01); *F04B 49/08* (2013.01); *F04B 53/007* (2013.01); *F04B 53/16* (2013.01)

(56) References Cited

U.S. PATENT DOCUMENTS

| | | | | |
|---|---|---|---|---|
| 5,992,450 | A | 11/1999 | Parker et al. | |
| 7,007,468 | B1 * | 3/2006 | Bennett | F04B 1/20 417/206 |
| 7,044,442 | B2 * | 5/2006 | Belser | 251/176 |
| 7,437,873 | B2 | 10/2008 | Wanschura et al. | |
| 2001/0042437 | A1 | 11/2001 | Trimble | |
| 2007/0130930 | A1 * | 6/2007 | Wanschura et al. | 60/444 |
| 2008/0219874 | A1 * | 9/2008 | Yamamuro et al. | 418/82 |
| 2008/0295682 | A1 * | 12/2008 | Crosby et al. | 91/505 |

* cited by examiner

CONNECTION PLATE FOR A HYDROSTATIC PISTON MACHINE

This application is a 35 U.S.C. §371 National Stage Application of PCT/DE2011/000255, filed on Mar. 12, 2011, which claims the benefit of priority to Ser. No. DE 10 2010 015 187.4, filed on Apr. 16, 2010 in Germany, the disclosures of which are incorporated herein by reference in their entirety.

The disclosure relates to a connection plate for a hydrostatic piston machine.

DE 10 2007 044 451 A1 discloses a connection plate of this type. This is part of a piston machine and has two axial connections, via which the piston machine is connected to a hydraulic circuit. Furthermore, the connection plate has a blind hole, into which a valve cartridge which is configured as a pressure control valve is inserted. Here, a cartridge axis of the valve cartridge extends parallel to a straight line which connects both centers of connection openings of the axial connections and between the two connection openings and a receptacle for an electropneumatic control valve. It is disadvantageous here that the installation space of the connection plates is utilized extremely poorly.

U.S. Pat. No. 5,992,450 discloses a connection plate for a gear pump, into which a bypass valve is inserted. The connection plate has two axial connections which are made in a common side face of the connection plate.

The document DE 101 36 416 A1 discloses a further connection plate for a piston machine. A pressure/flow regulator is flange-connected to the connection plate and is connected via channels in the connection plate to the hydraulic circuit of the piston machine. This solution has the disadvantage that the connection plate, together with the pressure/flow regulator, is of extremely complicated configuration in terms of apparatus technology.

In contrast, the disclosure is based on the object of providing a connection plate, in which connection openings of axial connections and a valve cartridge are advantageously arranged; the valve cartridge can then be connected to a pressure connection and/or a suction connection. Furthermore, a through-connected drive for a drive and/or output shaft of a piston machine should be made possible.

This object is achieved by a connection plate according to the disclosure.

According to the disclosure, a connection plate for a hydrostatic piston machine has two connection openings. Here, the latter are offset toward the same side with respect to the plate axis of the connection plate. In particular, they are situated on opposite side faces of the connection plate. Furthermore, two slots are formed from an inner side of the connection plate, which slots are connected in each case in the region of their first end section to one of the connection openings for connecting the piston machine to a hydraulic circuit. A valve cartridge which serves, in particular, as a regulating apparatus for the piston machine is inserted into an installation hole of the connection plate, which installation hole is configured, in particular, as a blind hole. The latter is formed in the connection plate so as to lie opposite the connection openings with regard to the plate axis. Its axis lies at least approximately in a plane which extends perpendicularly with respect to the plate axis. The valve cartridge is connected hydraulically to one of the slots, in particular to the slot which is connected to a pressure connection of the piston machine, in the region of its second end section. The two connection openings can be arranged axially, that is to say open to the "rear" in the direction of the plate axis.

This solution has the advantage that an installation space of the connection plate is utilized in an optimum manner, in particular as a result of the arrangement of the connection openings, the slots and the installation hole.

A pressure channel which is simple to produce is preferably provided for connecting the installation hole of the valve cartridge to the slot.

The valve cartridge is advantageously also connected via the installation hole, in addition to the pressure channel, to a tank channel which is made in the connection plate from the inner side of the latter in a manner which is extremely inexpensive in terms of production. Here, the tank channel can be connected to the slot which does not yet have a connection to the valve cartridge, in particular to the slot which is connected to a suction connection of the piston machine, in the region of its second end section.

In a further refinement of the disclosure, a control channel is provided which is open toward the inner side of the connection plate, is connected to the installation hole, and to which the valve cartridge is connected.

With low production outlay, the pressure channel, the tank channel and/or the control channel can be made in the connection plate from the same side (inner side) of said connection plate, as a hole which has a small length.

In order to utilize the installation space of the connection plate in a yet more improved manner, a depth of the slots is greater in the region of their first end section which is connected to the connection openings than in the region of their second end section.

A blind-hole-like (no through-connected drive) or continuous (with through-connected drive) receiving hole for a drive or output shaft of the piston machine is advantageously formed in the connection plate between the slots and approximately parallel to the plate axis and approximately perpendicularly with respect to the installation hole. In one embodiment with through-connected drive, the shaft can be coupled through the receiving hole to the shaft of a second machine.

In order to connect the connection openings to the slots, said connection openings are configured inexpensively as blind holes which intersect in each case the closest slot.

The valve cartridge is advantageously mounted into the installation hole from the side face which lies adjacently to the slot which is connected to the suction connection, as a result of which the installation hole is formed substantially in the low pressure region of the connection plate. During the use of the piston machine, this results in advantageous stress distribution in the region of the slot which is loaded with high pressure.

A spring which loads a regulating piston of the valve cartridge is preferably arranged on the outside in relation to the installation hole, as a result of which the spring force of the spring can be adjusted from the side face without dismantling of the valve cartridge.

The valve cartridge can have two valve bores with in each case one regulating piston which is received therein.

Advantageous developments of the disclosure are the subject matter of further subclaims.

Figure 2:
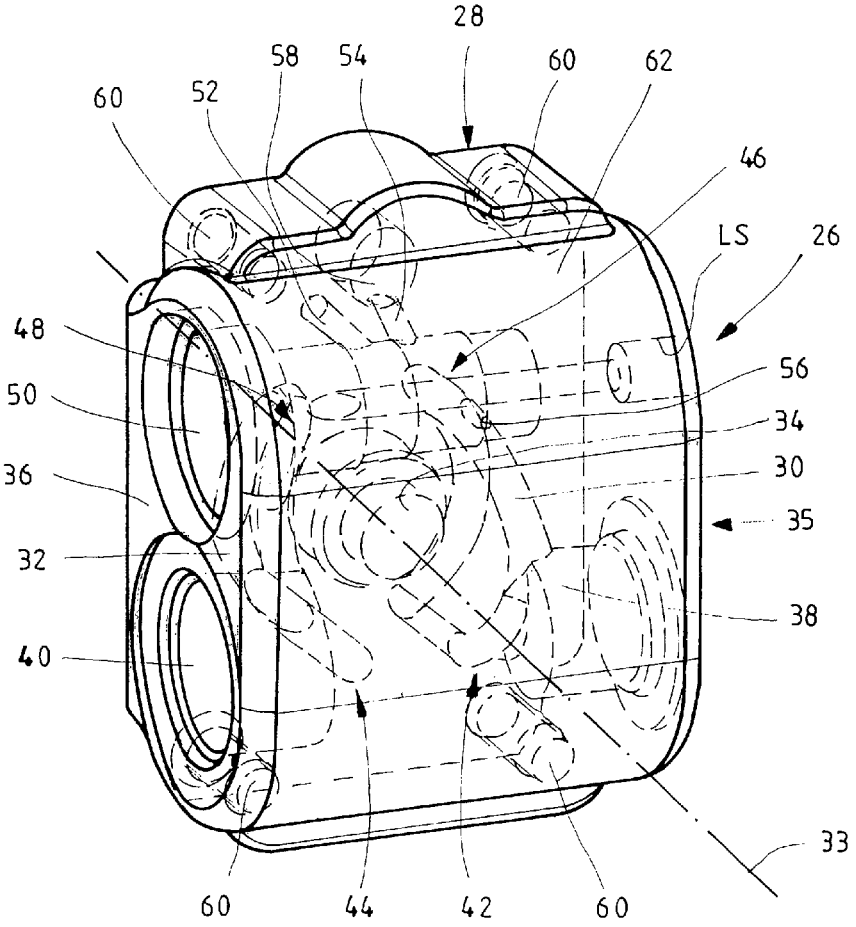
Figure 3:
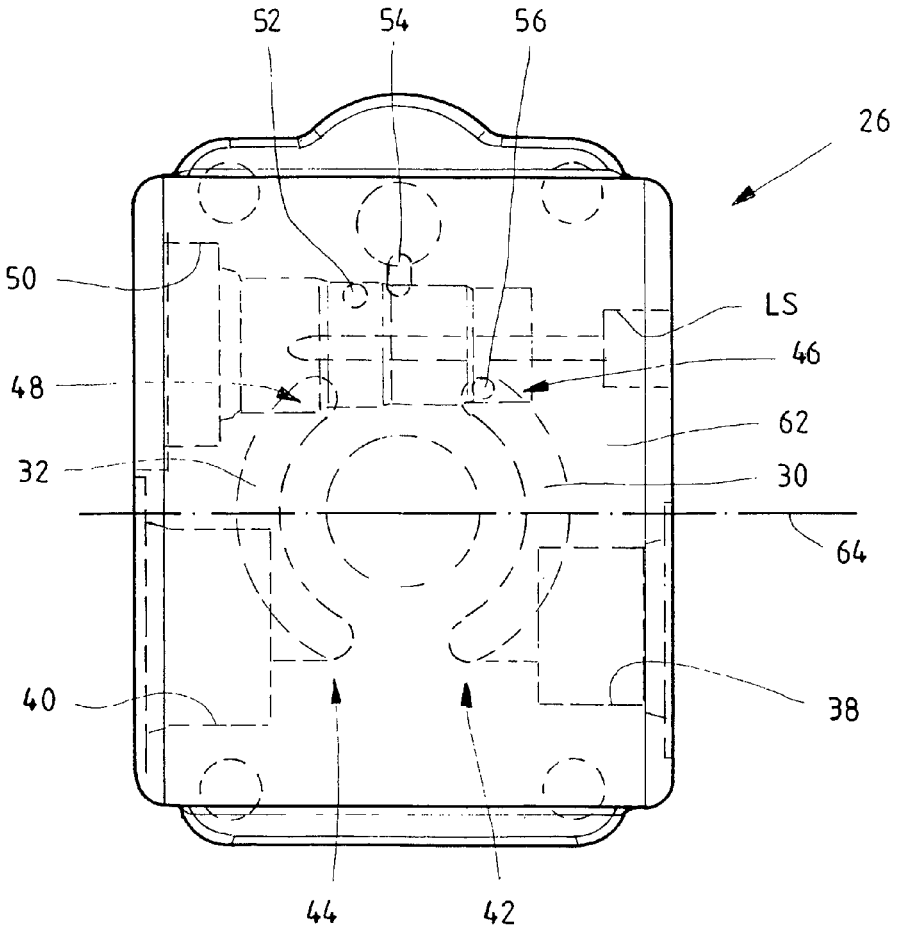
Figure 4:
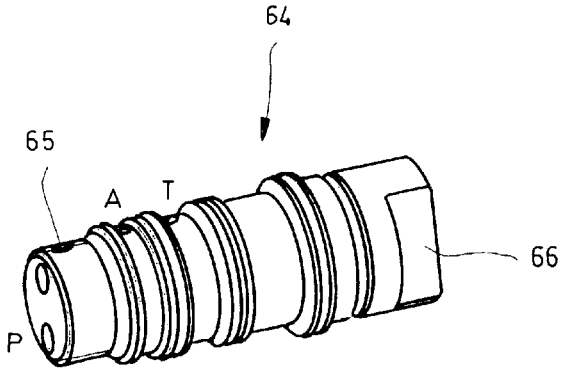
Figure 5:
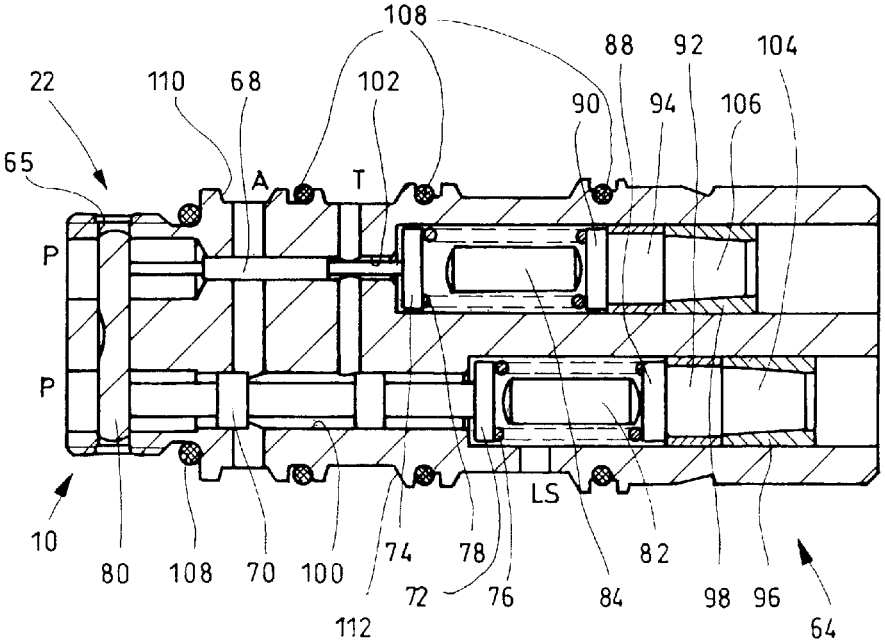
Figure 6:
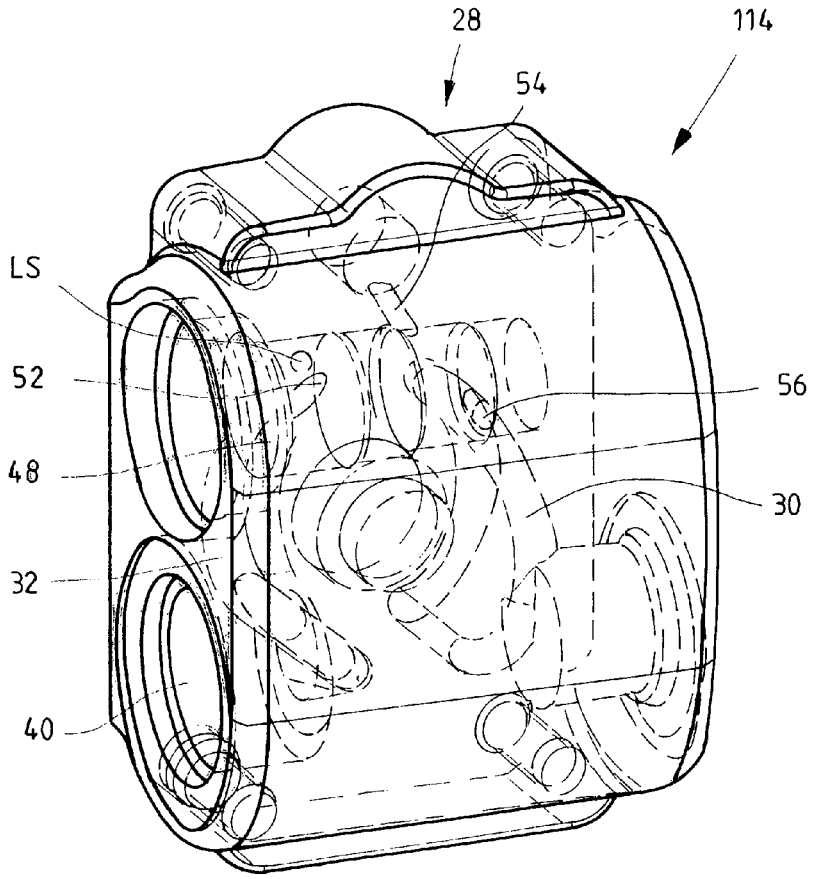
Figure 7:
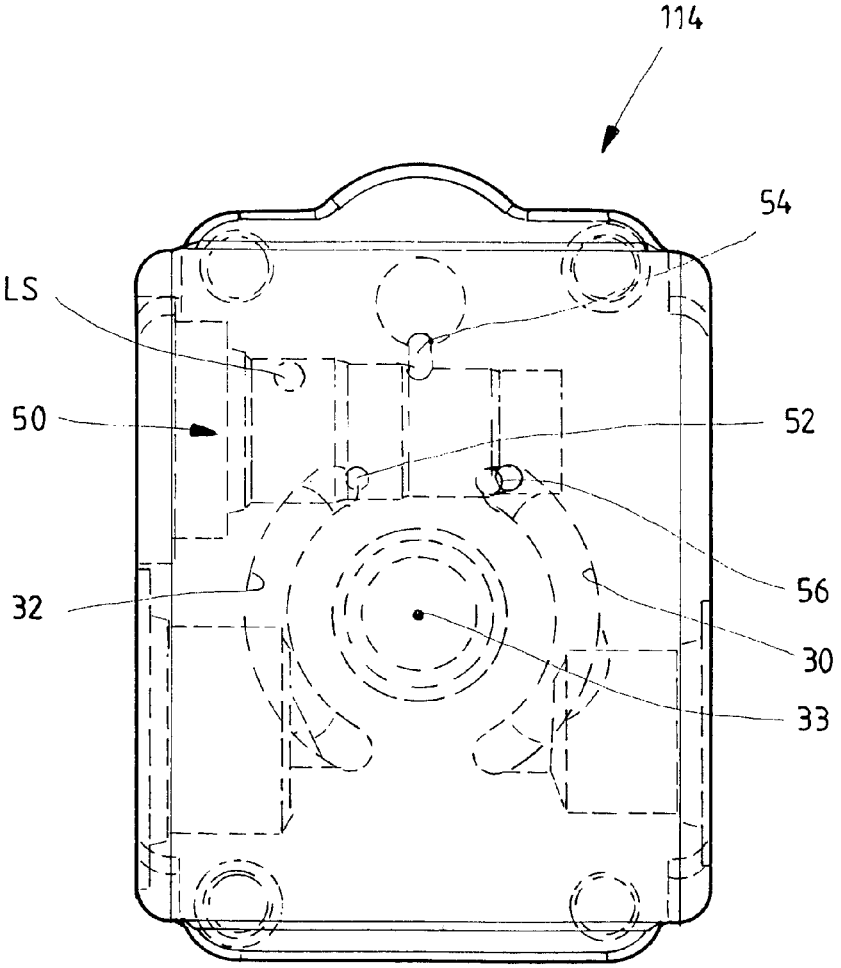
Figure 8:
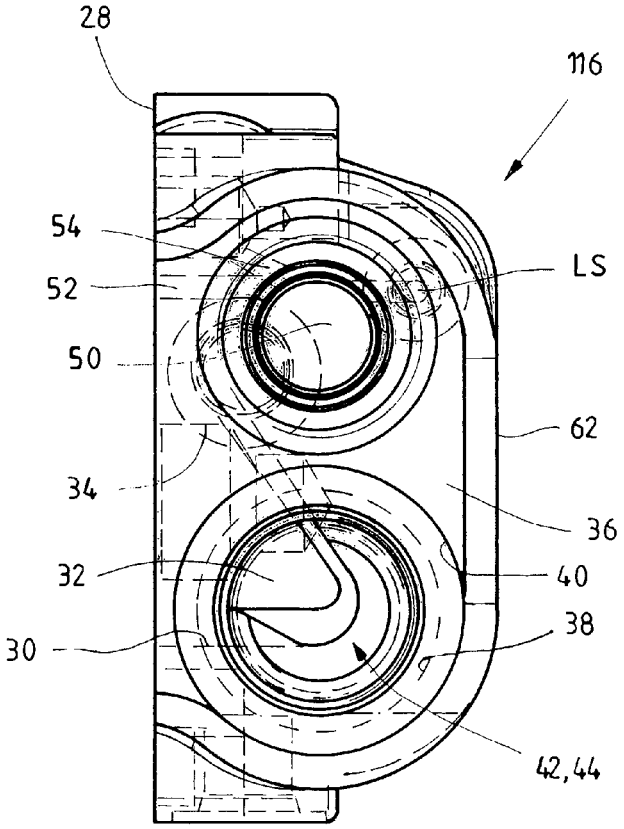

In the following text, preferred exemplary embodiments of the disclosure will be explained in greater detail using diagrammatic drawings, in which:

FIG. 1 shows a hydraulic circuit diagram of a piston machine having the connection plate according to the disclosure, FIG. 2 shows a perspective illustration of the connection plate according to a first exemplary embodiment, FIG. 3 shows a plan view of the connection plate from FIG. 2, FIG. 4 shows a perspective view of a valve cartridge for the connection plate, FIG. 5 shows a longitudinal sectional view of the valve cartridge from FIG. 4, FIG. 6 shows a perspective view of the connection plate according to a first exemplary embodiment, FIG. 7 shows a plan view of the connection plate from FIG. 6, and FIG. 8 shows a side view of the connection plate according to a third exemplary embodiment.

FIG. 1 shows a hydraulic circuit diagram of a hydrostatic piston machine which is configured here as a hydraulic pump 2, the throughput volume of which can be adjusted and set via an adjusting apparatus 4. Parts of the adjusting apparatus 4 and connections of the hydraulic pump 2 are part of a connection plate according to the disclosure which will be explained in greater detail below.

In the following text, only those elements of the hydraulic pump 2 which are essential to understand the disclosure will be described together with the adjusting apparatus 4. For further information, reference is made, for example, to the document DE 199 04 616 A1 or the document DE 44 10 156 B4.

The hydraulic pump 2, which is driven via a drive shaft 6, conveys pressure medium from a low pressure connection ND via a feed line 7 to a high pressure connection HD, to which hydraulic consumers are connected. These are, for example, consumers as shown in DE 44 10 156 B4. A respectively highest load pressure of the consumers is signaled via a load signaling line 8 to a flow control valve 10 of the adjusting device 4 of the hydraulic pump 2.

The flow control valve 10 has three connections, of which a working connection A is connected to an actuating cylinder 12 of the adjustable hydraulic pump 2. A pressure connection P of the flow control valve 10 is connected to the high pressure connection HD or the feed line 7 of the hydraulic pump 2 and a tank connection T is connected to a tank 14. A regulating piston of the flow control valve 10 is loaded in the direction of a connection of the working connection A to the pressure connection P by the pressure in the feed line 7 and is loaded in the direction of a connection of the working connection A to the tank connection T by the pressure in the load signaling line 8 and by a regulating spring 16. The shown load-sensing pump regulation brings the setting about of a pressure in the feed line 7, which pressure lies above the pressure in the load signaling line 8 by a pressure difference which is equivalent to the force of the regulating spring 16.

The tank connection T of the flow control valve 10 is connected firstly directly via a throttled tank line 20 to the tank 14 and secondly via a pressure control valve 22 to the tank 14.

The pressure control valve 22 likewise has three connections. Here, a connection A is in pressure-medium connection to the tank connection T of the flow control valve 10, a pressure connection P is in pressure-medium connection to the feed line 7, and a tank connection T is in pressure-medium connection to the tank 14. A regulating piston of the pressure control valve 22 is loaded in the direction of a connection of the connection A to the tank connection T by a regulating spring 24 and is loaded in the direction of a connection of the pressure connection P to the connection A by the pressure in the feed line 7. A maximum pump pressure of the hydraulic pump 2 can be set by way of the pressure control valve 22.

FIG. 2 shows a perspective illustration of a connection plate 26 according to the disclosure for a piston machine according to a first exemplary embodiment. Said connection plate 26 serves to connect a piston machine, for example a hydraulic pump 2 (see FIG. 1), to a hydraulic circuit. For this purpose, two approximately kidney-shaped slots 30, 32 are provided which are made from an approximately flat inner side 28 of the connection plate 26 (elements which are made in the connection plate 26 are shown using dashed lines). Said slots 30, 32 are formed approximately in the central region of the connection plate 26, their concave side faces pointing toward one another. The slots 30, 32 reach around a receiving hole 34, which defines he plate axis 33 and is made in the connection plate 26, for a drive or output shaft of the piston machine or hydraulic pump 2 which is configured with the connection plate 26. The inner side 28 of the connection plate extends perpendicularly with respect to the plate axis 33.

From a respective side face 35 and 36 of the connection plate 26, a connection opening 38, 40 which is formed as a blind hole is made in the connection plate 26 approximately perpendicularly with respect to the plate axis 33. The blind holes of the connection openings 38, 40 extend approximately coaxially with respect to one another. The connection openings 38, 40 are arranged offset with respect to the plate axis 33, in each case in a corner region of the connection plate 26. Here, a hole depth of the blind holes of the connection openings 38 and 40 is selected in such a way that they in each case intersect the closest slot 30 or 32 for the hydraulic connection. Here, the slots 30 and 32 are intersected in each case by the connection opening 38 and 40, respectively, in the region of their first, lower (in FIG. 2) end section 42 and 44.

The slots 30 and 32 in each case have a depth which decreases substantially constantly in each case from the first end section 42 and 44 in the direction of a second end section 46 or 48. In FIG. 2, the second end sections 46 and 48 are arranged above the plate axis 33. The small depth of the slots 30, 32 in the region of their second end sections 46 and 48 makes it possible to form an installation hole 50 in the connection plate 26 in this region. Said installation hole 50 serves to receive a valve cartridge which is explained in greater detail in FIGS. 4 and 5 which follow. Here, the valve cartridge has the flow control valve 10 and the pressure control valve 22 from FIG. 1. The installation hole 50 is formed as a blind hole and is made in the connection plate 26 from the left-hand (in FIG. 2) side face 36 of said connection plate 26. A hole axis of the installation hole 50 extends approximately at a parallel spacing from the axes of the connection openings 38, 40 and is arranged so as to lie opposite the connection openings 38, 40 in relation to the plate axis 33 in the connection plate 26, and therefore above the through-connected drive 34 in FIG. 2.

The right-hand slot 30 in FIG. 2 is connected to the high pressure of the piston machine, whereas the left-hand slot 32 is connected to the low pressure.

Three channels 52, 54 and 56 which are made in the connection plate 26 from the inner side 28 of said connection plate 26 open into the installation hole 50. The channels 52 to 56 are in pressure-medium connection with the valve cartridge which is inserted into the installation hole 50, which is explained in greater detail below. The right-hand channel 56 in FIG. 2 is a pressure channel 56 which opens firstly, as already described, into the installation hole 50 and secondly into the second end section 46 of the slot 30 and is therefore connected to the feed line 7 in FIG. 1. The central channel 54 in FIG. 2 is a control channel 54 which connects the flow control valve 10 in the valve cartridge described below to the actuating cylinder 12 (see FIG. 1). Here, the control channel 54 opens firstly into the installation hole 50 and secondly into a channel 58 which has a greater diameter than the control channel 54. Said channel 58 is made as a blind hole from the inner side 28 of the connection plate 26, so as to lie opposite the connection openings 38, 40 with regard to the installation hole 50. The control channel 54 is made in the connection plate 26 from the channel 58 to the installation hole 50, obliquely in relation to the plate axis 33. The left-hand channel 52 in FIG. 2 is a tank channel 52 which is made as a hole in the connection plate 26 from the inner side 28 of said connection plate 26, approximately parallel to the plate axis 33, and is in pressure-medium connection with the tank 14 from FIG. 1.

In its corner regions, the connection plate 26 has through holes 60 which extend approximately parallel to the plate axis 33 and via which the connection plate 26 is fastened to the piston machine by way of corresponding means, for example screws. Furthermore, the connection plate 26 has an outer side 62 which faces away from the inner side 28 and the upper and lower (in FIG. 2) end sections of which are configured in the region of the installation hole 50 and the connection openings 38, 40 so as to be curved around their axes, which leads to a compact construction of the connection plate 26.

FIG. 3 shows the connection plate 26 from FIG. 2 in a plan view of the outer side 62. Elements which are made in the connection plate 26 are shown using dashed lines as in FIG. 2. It can be seen in this view that the installation hole 50 covers the second end sections 46 and 48 of the slots 30 and 32 in sections in the direction of the plate axis 33 (see FIG. 2). Here, a longitudinal axis of the installation hole 50 is arranged below the slots 30, 32 in FIG. 3. A depth of the installation hole 50 is selected in such a way that said installation hole 50 extends approximately as far as the region of the end section 46 of the right-hand slot 30. The slots 30, 32 in each case run around a circular circumferential section, a spacing between the second end sections 46, 48 and between the first end sections 42, 44 being approximately equal.

The connection openings 38, 40 have a different diameter, the diameter of the right-hand (in FIG. 3) connection opening 38 being smaller than that of the connection opening 40.

In FIG. 3, the pressure channel 56 is configured to be slightly oblique in relation to a plate axis 64 from the slot 30 to the installation hole 50, which plate axis 64 extends approximately parallel to the installation hole 50.

A control connection LS, to which the load signaling line 8 which can be seen from FIG. 1 is to be connected, is also situated on the side face 35. A hole extends from the control connection LS parallel to the installation hole 50 and is open to the installation hole 50 at a small spacing from the side face 36.

FIG. 4 shows a perspective view of a valve cartridge 64 which can be inserted into the installation hole 50 of the connection plate 26 from FIG. 2. Said valve cartridge 64 can be inserted with its left-hand (in FIG. 4) side first into the installation hole 50 from FIG. 2. The valve cartridge 64 is a pressure/flow regulator having the flow control valve 10 and the pressure control valve 22 from FIG. 1.

Three connections are configured on the outer circumference of the valve cartridge 64. A pressure connection P which is arranged on the end side with two holes serves to signal a pump pressure of the hydraulic pump 2 from FIG. 1, each of the two valves 10, 22 from FIG. 1 being assigned a hole of the pressure connection P. A working connection A serves to set a pivoting angle of the hydraulic pump 2 via the actuating cylinder 12 (see FIG. 1), and a tank connection T is connected to the tank 14.

A continuous transverse hole 65 which will be explained with reference to FIG. 5 is provided in the valve cartridge 64 adjacently to the pressure connection P. In order to screw in the valve cartridge 64, a dihedron is provided, of which only a flat section 66 is shown in FIG. 4.

FIG. 5 shows a longitudinal sectional view of the valve cartridge 64 from FIG. 4. The pressure control valve 22 which is shown at the top in FIG. 4 and the flow control valve 10 in each case have a regulating piston 68 and 70, respectively. The latter are prestressed to the left (in FIG. 5) into their basic position shown by springs 76 and 78 in each case via a spring collar 72 and 74. The movement of the regulating pistons 68, 70 to the left (in FIG. 5) is limited by a stop pin 80 which is pressed into the continuous transverse hole 65.

Via the control pressure which prevails at the pressure connection P, the regulating pistons 68, 70 and the associated spring collars 72, 74 can be displaced proportionally to the right (in FIG. 5) into their switching positions. This movement counter to the force of the springs 76, 78 is limited by respective cylindrical stop pins 82 and 84 which act as spacing bridge elements and are received in the interior of the respective spring 76, 78 approximately parallel to a center axis 86 of the valve cartridge 64, without further fixing.

The springs 76 and 78 are supported in each case on a disk 88 and 90 which are supported on a respective conical sleeve 96 and 98 in each case via a spacer sleeve 92 and 94. The two conical sleeves 96 and 98 are fixed frictionally in a respective valve bore 100 and 102. To this end, the conical sleeves 96 and 98 have frustoconical inner recesses, into which corresponding truncated cones 104 and 106 are pressed. The pressing-in operation took place during the mounting of the valves 10, 22 by displacement or pulling of the truncated cones 104, 106 to the right (in FIG. 5) in the associated conical sleeves 96, 98.

A load signaling connection LS (load signaling line 8 from FIG. 1) is provided as a further connection of the flow control valve 10, at which load signaling connection LS the pressure of the highest-load consumers which are supplied by the hydraulic pump 2 from FIG. 1 prevails. A spring space of the flow control valve 10 is connected via a transverse hole to the load signaling connection LS, whereas a spring space of the pressure control valve 22 is connected to the tank connection T via a pressure-medium connection which is formed between the regulating piston 68 and the valve bore 102 and via a transverse hole section.

In each case one sealing ring 108 is arranged in each case in a circumferential groove on the outer circumference of the valve cartridge 64 between the right-hand (in FIG. 5) or outer end section of the valve cartridge 64 and the load signaling connection LS, and between the load signaling connection LS and the tank connection T, and between the tank connection T and the working connection A, and between the working connection A and the pressure connection P.

As a result of the basic positions (shown in FIG. 5) of the regulating pistons 68, 70, connections between the connections A and P are shut off by way of a respective piston collar of the two regulating pistons 68, 70, whereas the connection A is connected to the tank connection T via a pressure-medium connection which is formed between the regulating piston 70 and the valve bore 100 and, furthermore, via two transverse hole sections, and is therefore relieved to the tank 14 from FIG. 1. As a result of pressure loading (of the two holes) of the pressure connection P, the two regulating pistons 68, 70 can be displaced to the right (in FIG. 5) in each case counter to the force of the associated spring 76, 78, both valves 10, 22 opening a connection from the pressure connection P to the working connection A. The hydraulic pump 2 from FIG. 1 is therefore pivoted back, with the result that its pressure and/or its flow are/is reduced. The pressure control valve 22 has decision priority over the flow control valve 10.

In the inserted state of the valve cartridge 64 in the installation hole 50 from FIG. 2 or 3, the pressure connection P of the valve cartridge 64 is in pressure-medium connection with the pressure channel 56 and therefore with the slot 30 of the connection plate 26. The working connection A of the valve cartridge 64 is connected to the control channel 54, and the tank connection is connected to the tank channel 52. In the region of the working connection A and the tank connection T, the valve cartridge 64 has in each case one circumferential groove 110 and 112 (see FIG. 5) which in each case delimits a pressure medium space together with the installation hole 50, into which in each case one of the channels 52, 54 opens. It is conceivable that the valves 10, 22 from FIG. 5 are in pressure-medium connection with the pressure channel 56 via the transverse hole 65.

FIG. 6 shows a perspective illustration of the connection plate 114 according to a second exemplary embodiment. In contrast to the first exemplary embodiment from FIG. 2, the tank channel 52 opens into the upper (in FIG. 6) end section 48 of the left-hand slot 32. Here, the tank channel 52 is made as a hole in the connection plate 114 from the inner side 28 of said connection plate 114. As a result of the arrangement of the tank channel 52, the tank connection T of the valve cartridge 64 is in pressure-medium connection with the connection opening 40 of the connection plate 114 with low outlay in terms of apparatus technology.

FIG. 7 depicts the connection plate 114 in a plan view. The two channels 52, 56 open into a lower (in FIG. 7) region of the installation hole 50, which region points toward the plate axis 33, as a result of which said channels 52, 56 are made as a hole in the connection plate 114 with a lower obliqueness with regard to the plate axis 33 and a small axial length from the slots 30, 32. In accordance with FIG. 3, the control channel 54 opens into an upper (in FIG. 7) region of the installation hole 50, which region points away from the plate axis 33, as a result of which its axial length is likewise extremely small.

In the exemplary embodiment according to FIGS. 6 and 7, the LS connection is guided to the outside perpendicularly with respect to the installation hole 50.

FIG. 8 shows a side view of the connection plate 116 according to a third exemplary embodiment. A blind-hole-like receiving hole 34 is once again formed from the inner side 28. In this view, the constantly decreasing depth of the slots 30, 32 can be seen, which depth is greatest in the region of the lower (in FIG. 8) end sections 42, 44. Here, the depth is greater than the parallel spacing of the axis of the connection openings 38, 40 from the inner face 28. The smallest depth is configured in the region of the upper (in FIG. 8) end sections 46 and 48 of the slots 30, 32.

Here, said smallest depth is more than half as small as the greatest depth. As a result, the installation hole 50 can be made in the connection plate 26 at least in sections between the slots 30, 32 and the outer side 62 of said connection plate 26, which leads to a compact overall size of the connection plate 26.

In all the exemplary embodiments, the receiving hole 34 can also pass through the connection plate, in order for it to be possible to connect the shaft of a second hydraulic machine to the shaft of the hydraulic machine, to which the connection plate with a continuous receiving hole belongs.

In the connection plate according to FIG. 8, the LS connection is arranged as in the embodiment according to FIGS. 2 and 3.

A connection plate for a hydrostatic piston machine is disclosed, having two connection openings on opposite side faces of the connection plate. Said connection openings are arranged on a common side such that they are offset with respect to a main axis of the connection plate. Two slot-shaped cutouts are formed from an inner side of the connection plate, which cutouts are connected, in each case in the region of their first end section, to one of the connection openings in order to connect the piston machine to a hydraulic circuit. A valve cartridge is inserted into an installation hole of the connection plate. Said installation hole is formed in the connection plate so as to lie opposite the plate axis with regard to the connection openings, and extends approximately parallel to axes of the connection openings. The valve cartridge is connected hydraulically to one of the slots.

The invention claimed is:

1. A connection plate for a hydrostatic piston machine:

the connection plate having a connection plate axis that extends from a center of the connection plate in a direction normal to a plane of the connection plate;

the connection plate defining:

two connection openings that are offset toward a same side of the connection plate with respect to the connection plate axis, two slots on an inner side of the connection plate, each of the two slots being connected in a region of a respective first end section to one of the two connection openings and being configured to connect the piston machine to a hydraulic circuit, and an installation hole that is opposite to the two connection openings with respect to the connection plate axis, and that extends substantially in the plane of the connection plate;

a control channel which is open to the inner side of the connection plate and which is connected to the installation hole;

a pressure channel configured to connect the installation hole to the one of the two slots; and a tank channel which is open to the inner side of the connection plate and to which the valve cartridge is connected, wherein at least one of the pressure channel, the tank channel, and the control channel are formed as a hole in the connection plate; and the connection plate including a valve cartridge configured as a regulating apparatus of the piston machine, the valve cartridge being inserted in the installation hole, and the valve cartridge being connected to a respective second end section region of one of the two slots.

2. The connection plate as claimed in claim 1, wherein the two connection openings are respectively situated on opposite side faces of the connecting plate;

each of the two connection openings having an axis that lies in the plane of the connecting plate.

3. The connection plate according to claim 2, wherein an axis of the installation hole extends substantially parallel to the axes of the two connection openings.

4. The connection plate as claimed in claim 1, further comprising a pressure channel configured to connect the installation hole to the one of the two slots.

5. The connection plate as claimed in claim 1, further comprising a tank channel which is open to the inner side of the connection plate and to which the valve cartridge is connected.

6. The connection plate as claimed in claim 5, wherein the tank channel is connected to an other of the two slots.

7. The connection plate as claimed in claim 6, where the other of the two slots is connected to a suction side of the piston machine.

8. The connection plate as claimed in claim 1, wherein the first end section regions of the two slots each have a respective first depth from the inner side of the connection plate that is greater than a second depth from the inner side of the connection plate of the corresponding second end section region thereof.

9. The connection plate as claimed in claim 1, wherein the connection plate defines a receiving hole configured to receive a drive or output shaft of the piston machine, the receiving hole being located on the connection plate approximately between the two slots.

10. The connection plate as claimed in claim 1, wherein each of the two connection openings are defined by blind holes which respectively intersect one of the two slots.

11. The connection plate as claimed in claim 1, further comprising a spring, wherein:

the valve cartridge further includes a regulating piston;

the spring is configured to load the regulating piston of the valve cartridge; and the spring is arranged on an outside of the connecting plate in relation to the installation hole.

12. The connection plate as claimed in claim 1, wherein the valve cartridge defines two valve bores, and further includes a respective regulating piston received in each of the two valve bores.

13. The connection plate as claimed in claim 1, wherein the one of the two slots to which the valve cartridge is connected is connected to a pressure side of the piston machine.

14. The connection plate as claimed in claim 13, wherein the valve cartridge is mounted into the installation hole from a side face of the connecting plate which is remote from the one of the two slots.

* * * * *